US011371512B2

(12) United States Patent
Shakuda et al.

(10) Patent No.: US 11,371,512 B2
(45) Date of Patent: Jun. 28, 2022

(54) CENTRIFUGAL COMPRESSOR AND SEAL UNIT

(71) Applicant: MITSUBISHI HEAVY INDUSTRIES COMPRESSOR CORPORATION, Tokyo (JP)

(72) Inventors: Masaki Shakuda, Hiroshima (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 48 days.

(21) Appl. No.: 16/662,823

(22) Filed: Oct. 24, 2019

(65) Prior Publication Data

US 2020/0132078 A1 Apr. 30, 2020

(30) Foreign Application Priority Data

Oct. 26, 2018 (JP) ..... JP2018-202008

(51) Int. Cl.
*F04D 17/10* (2006.01)
*F04D 29/08* (2006.01)
*F04D 29/16* (2006.01)

(52) U.S. Cl.
CPC ..... *F04D 17/10* (2013.01); *F04D 29/083* (2013.01)

(58) Field of Classification Search
CPC .... F04D 29/083; F04D 29/162; F04D 29/284; F04D 29/102; F04D 29/167; F04D 29/584; F04D 29/106; F04D 17/10; F04D 17/12; F04D 29/2266; F04D 29/701; F04D 29/4206; F04D 29/668; F04D 17/122; F04D 29/667; F04D 29/669; F04D 29/685; F01D 11/02; F01D 11/04; F01D 11/003; F01D 11/025; F01D 11/12; F01D 11/122; F05D 2210/42; F05D 2250/51
See application file for complete search history.

(56) References Cited

U.S. PATENT DOCUMENTS 5,161,943 A 11/1992 Maier et al.
5,190,440 A 3/1993 Maier et al.
(Continued)

FOREIGN PATENT DOCUMENTS

EP 2615338 A1 7/2013
JP 2003-148397 A 5/2003
(Continued)

*Primary Examiner* — Eric J Zamora Alvarez
(74) *Attorney, Agent, or Firm* — Osha Bergman Watanabe & Burton LLP

(57) ABSTRACT

A centrifugal compressor includes a housing 20 having a facing surface 22*f* facing the outer peripheral surface of a cover 43, a seal member 50 forming a clearance with the outer peripheral surface of the cover 43, an inclined hole 55 formed in the seal member 50, extending at an angle to the side opposite to a direction of rotation, and having an opening portion 57 opening at a position facing the outer peripheral surface of the cover 43, a first fin 52 provided on the seal member 50 and protruding toward the outer peripheral surface of the cover 43, and a communication flow path portion 64 formed in the housing 20, having an introduction port 66*i* opening at a position facing the outer peripheral surface of the cover 43, and communicating with the inclined hole 55.

6 Claims, 5 Drawing Sheets

(56) References Cited

U.S. PATENT DOCUMENTS

| | | | | |
|---|---|---|---|---|
| 6,039,535 | A * | 3/2000 | Kobayashi | F04D 29/102 415/172.1 |
| 2010/0119367 | A1 | 5/2010 | Nakaniwa | |
| 2013/0164119 | A1 | 6/2013 | Nakaniwa | |
| 2015/0240833 | A1 | 8/2015 | Bigi et al. | |
| 2018/0030992 | A1* | 2/2018 | Masutani | F04D 25/163 |

FOREIGN PATENT DOCUMENTS

| | | | |
|---|---|---|---|
| JP | 2007-177737 | A | 7/2007 |
| JP | 2008-303767 | A | 12/2008 |
| JP | 2012-057726 | A | 3/2012 |
| WO | 2018-077691 | A1 | 5/2018 |

* cited by examiner

CENTRIFUGAL COMPRESSOR AND SEAL UNIT

BACKGROUND OF THE INVENTION

Field of the Invention

The present invention relates to a centrifugal compressor and a seal unit.

Priority is claimed on Japanese Patent Application No. 2018-202008, filed on Oct. 26, 2018, the content of which is incorporated herein by reference.

Description of Related Art

A gas-compressing centrifugal compressor is widely known as a rotary machine. In this centrifugal compressor, a working fluid such as the gas that has flowed in from a suction port is compressed by the rotation of an impeller provided in a housing and discharged from a discharge port.

In such a centrifugal compressor, the working fluid in the gap between a rotating body such as the impeller and a stationary body such as the housing around the rotating body is circumferentially moved so as to follow the surface of the rotating body as the rotating body rotates. A swirling flow (swirl) is generated as a result. This swirling flow may result in vibration excitation in the rotary shaft to which the impeller is fixed.

Japanese Unexamined Patent Application, First Publication No. 2007-177737 discloses a configuration including a communication hole connecting an inlet hole and an outlet hole in order to suppress the impact of a swirling flow. The inlet hole is provided on a radially outer side with respect to an impeller and the outlet hole is provided directly behind a labyrinth seal on the inlet side of the impeller (rotating body). The outlet hole is provided at an angle in the direction opposite to the direction of rotation of the impeller. In such a configuration, a high-pressure working fluid compressed through the impeller is ejected from the outlet hole toward the outer peripheral surface of the impeller in the direction opposite to the direction of rotation of the impeller. A swirling flow generated with the rotation of the impeller is mitigated as a result.

SUMMARY OF THE INVENTION

It is necessary to increase the differential pressure between the inlet hole and the outlet hole and the ejection pressure of the working fluid in order to sufficiently obtain the effect of mitigating the swirling flow attributable to the working fluid ejected from the outlet hole. Accordingly, in the configuration disclosed in Japanese Unexamined Patent Application, First Publication No. 2007-177737, the inlet hole is open on a side surface of a flow path formed in a housing on the radially outer side with respect to the impeller such that the high-pressure working fluid compressed through the impeller is taken in. However, the communication hole becomes long when the inlet hole is provided at a position away from the outlet hole, and then a large space becomes necessary for communication hole formation and a reduction in rotary machine size is hindered.

The present invention provides a centrifugal compressor and a seal unit capable of reducing a necessary space while reducing a swirling flow generated with impeller rotation.

A centrifugal compressor according to a first aspect of the present invention includes a rotary shaft which is configured to rotate around an axis, an impeller having a disk fixed to the rotary shaft, a plurality of blades provided on a surface of the disk facing a first side in an axial direction and provided at intervals in a circumferential direction around the axis, and a cover provided on the first side in the axial direction with respect to the disk and the blade and having an outer peripheral surface extending outward in a radial direction toward a second side in the axial direction, a housing covering the rotary shaft and the impeller and having a facing surface formed on the first side in the axial direction with respect to the outer peripheral surface and facing the outer peripheral surface, a seal member forming a clearance with the outer peripheral surface inward of the facing surface in the radial direction in the housing, a plurality of inclined holes formed at intervals in the circumferential direction with respect to the seal member, respectively extending at an angle to a side opposite to a direction of rotation of the rotary shaft toward an inner side in the radial direction, and having an opening portion opening at a position facing the outer peripheral surface, a first fin disposed on the seal member on the second side in the axial direction with respect to the opening portion and protruding from the seal member toward the outer peripheral surface, and a communication flow path portion formed in the housing, having an introduction port opening at a position facing the outer peripheral surface inward in the radial direction of an outer peripheral end on an outermost side in the radial direction in the cover, and communicating with the plurality of inclined holes.

By such a configuration being adopted, part of a working fluid increased in pressure flows into the gap between the outer peripheral surface of the cover and the facing surface of the housing and reaches the second side in the axial direction with respect to the first fin. In contrast, the pressure of the working fluid is low on the first side in the axial direction with respect to the first fin. Accordingly, the pressure of the introduction port of the communication flow path portion becomes higher than the pressure of the opening portion of the inclined hole. Due to the differential pressure between the introduction port and the opening portion generated in this manner, part of the working fluid is ejected from the opening portion through the inclined hole from the communication flow path portion. It is possible to suppress the working fluid between the seal member and the outer peripheral surface of the cover swirling with the rotation of the impeller by the working fluid ejected in the direction opposite to the direction of rotation of the rotary shaft from the opening portions of the plurality of inclined holes. The introduction port of the communication flow path portion is open radially inward of the outer peripheral portion of the cover of the impeller. Accordingly, the introduction port does not have to be provided on the radially outer side of the impeller. Accordingly, no large space is required for the communication flow path portion to be formed and the centrifugal compressor can be reduced in size.

In the centrifugal compressor according to a second aspect of the present invention, the housing may have a housing main body, and a seal holder detachably provided from the housing main body and holding the seal member and the communication flow path portion may be formed in the seal holder.

Since the communication flow path portion is formed in the seal holder as described above, machining for forming the communication flow path portion does not have to be performed on the housing main body. By attaching the seal member and the seal holder where the communication flow path portion is formed to the housing main body, it is possible to realize the centrifugal compressor that is capable of reducing a necessary space while reducing the swirling flow that is generated as the impeller rotates.

In the centrifugal compressor according to a third aspect of the present invention, the communication flow path portion may have a circumferential flow path continuous in the circumferential direction and communicating with the plurality of inclined holes, and a plurality of introduction flow paths connecting the introduction port and the circumferential flow path.

By such a configuration being adopted, part of the working fluid sent radially outward through the impeller can be merged into the circumferential flow path from the introduction flow path and sent into the plurality of inclined holes. Accordingly, the working fluid can be supplied to the plurality of inclined holes under the same conditions regardless of the position in the circumferential direction.

The centrifugal compressor according to a fourth aspect of the present invention may further include a second fin provided on the seal member on the first side in the axial direction with respect to the opening portion and protruding from the seal member toward the outer peripheral surface.

By such a configuration being adopted, direct merging between the working fluid that is ejected from the opening portion of the inclined hole and the pre-compression working fluid is suppressed by the second fin. Accordingly, it is possible to reliably exhibit the effect of suppressing the swirling flow that is attributable to the working fluid ejected from the inclined hole.

A seal unit according to a fifth aspect of the present invention is a seal unit to be mounted onto a centrifugal compressor including a rotary shaft rotating around an axis, an impeller having a disk fixed to the rotary shaft, a plurality of blades provided on a surface of the disk facing a first side in an axial direction and provided at intervals in a circumferential direction around the axis, and a cover provided on the first side in the axial direction with respect to the disk and the blade and having an outer peripheral surface extending outward in a radial direction toward a second side in the axial direction, and a housing covering the rotary shaft and the impeller and having a facing surface formed on the first side in the axial direction with respect to the outer peripheral surface and facing the outer peripheral surface. The seal unit includes an annular seal member allowed to be disposed so as to form a clearance with the outer peripheral surface inward of the facing surface in the radial direction in the housing, a plurality of inclined holes formed at intervals in the circumferential direction with respect to the seal member, respectively extending at an angle in the circumferential direction toward an inner side in the radial direction, and having an opening portion opening on an inner peripheral surface of the seal member, and a first fin disposed on the seal member on the second side in the axial direction with respect to the opening portion and protruding from the seal member. The plurality of inclined hole are communicable with a side inward in the radial direction of an outer peripheral end on an outermost side in the radial direction in the cover.

By attaching the seal unit to the housing main body of the centrifugal compressor, it is possible to realize the centrifugal compressor that is capable of reducing the necessary space while reducing the swirling flow that is generated as the impeller rotates.

According to the present invention, it is possible to reduce the necessary space while reducing the swirling flow generated with impeller rotation.

DETAILED DESCRIPTION OF THE INVENTION

Hereinafter, a mode for carrying out a centrifugal compressor and a seal unit according to the present invention will be described with reference to the accompanying drawings. The present invention is not limited to these embodiments.

Figure 1:
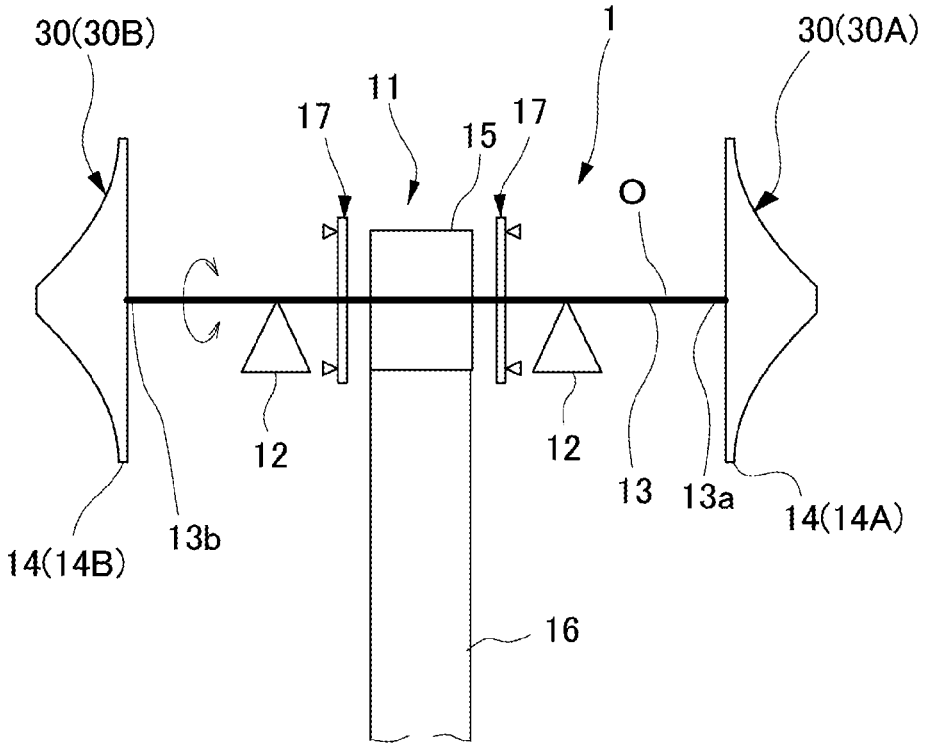
FIG. 1 is a schematic diagram showing the configuration of a centrifugal compressor according to an embodiment of the present invention.
Figure 2:
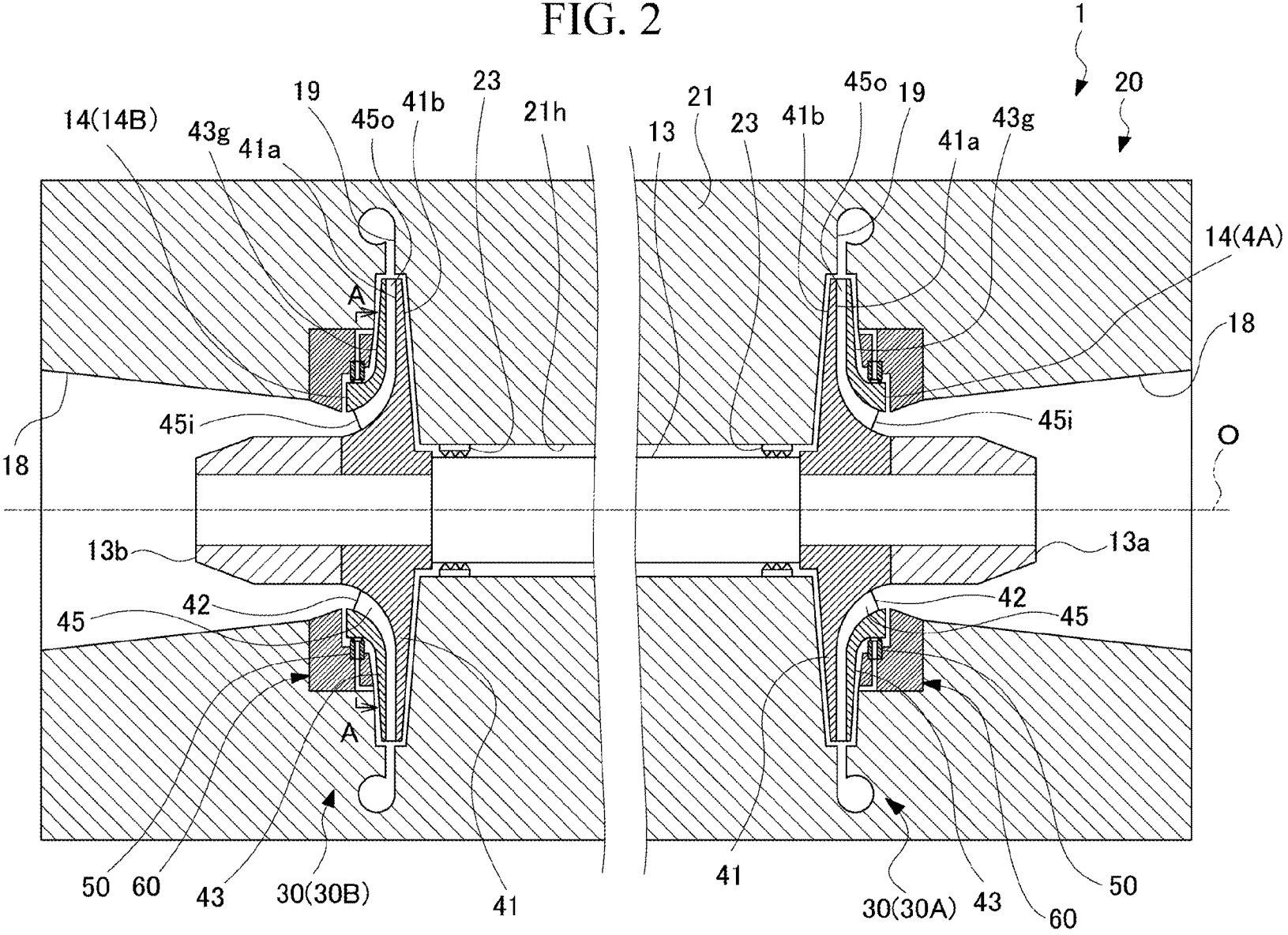
FIG. 2 is a cross-sectional view showing the structure around an impeller provided in the centrifugal compressor.

As shown in FIGS. 1 and 2, a geared centrifugal compressor (centrifugal compressor) 1 according to the present embodiment is provided with a housing 20 (see FIG. 2), a radial bearing 12 (see FIG. 1), a rotary shaft 13, and an impeller 14.

The housing 20 has a housing main body 21 and a seal holder 60 (described later). The housing main body 21 forms the outer shell of the geared centrifugal compressor 1.

As shown in FIG. 1, a pair of the radial bearings 12 are provided at an interval in the direction of an axis O of the rotary shaft 13. The radial bearing 12 is fixed to the housing main body 21.

As shown in FIG. 2, the rotary shaft 13 is inserted through a shaft insertion hole 21*h* formed in the housing main body 21. A seal ring 23 corning into sliding contact with the outer peripheral surface of the rotary shaft 13 is provided on the inner peripheral surface of the shaft insertion hole 21*h*. As shown in FIG. 1, the rotary shaft 13 is supported by the pair of radial bearings 12 so as to be rotatable around the axis O of the rotary shaft 13.

The rotary shaft 13 is provided with a pinion gear 15 between the pair of radial bearings 12. A large-diameter gear 16 meshes with the pinion gear 15. The large-diameter gear 16 is driven to rotate by an external drive source. The large-diameter gear 16 is set so as to be larger in outer diameter dimension than the pinion gear 15. Accordingly, the rotational speed of the rotary shaft 13 having the pinion gear 15 exceeds the rotational speed of the large-diameter gear 16.

The pinion gear 15 and the large-diameter gear 16 constitute a speed-increasing transmission unit 11. The speed-increasing transmission unit 11 increases the speed of rotation of the large-diameter gear 16 by the external drive source via the pinion gear 15 and transmits the speed to the rotary shaft 13.

The rotary shaft 13 is provided with a thrust bearing 17 at a position separated from the pinion gear 15 in the axis O direction. The thrust bearing 17 restrains the rotary shaft 13 from moving in the axis O direction.

Figure 3:
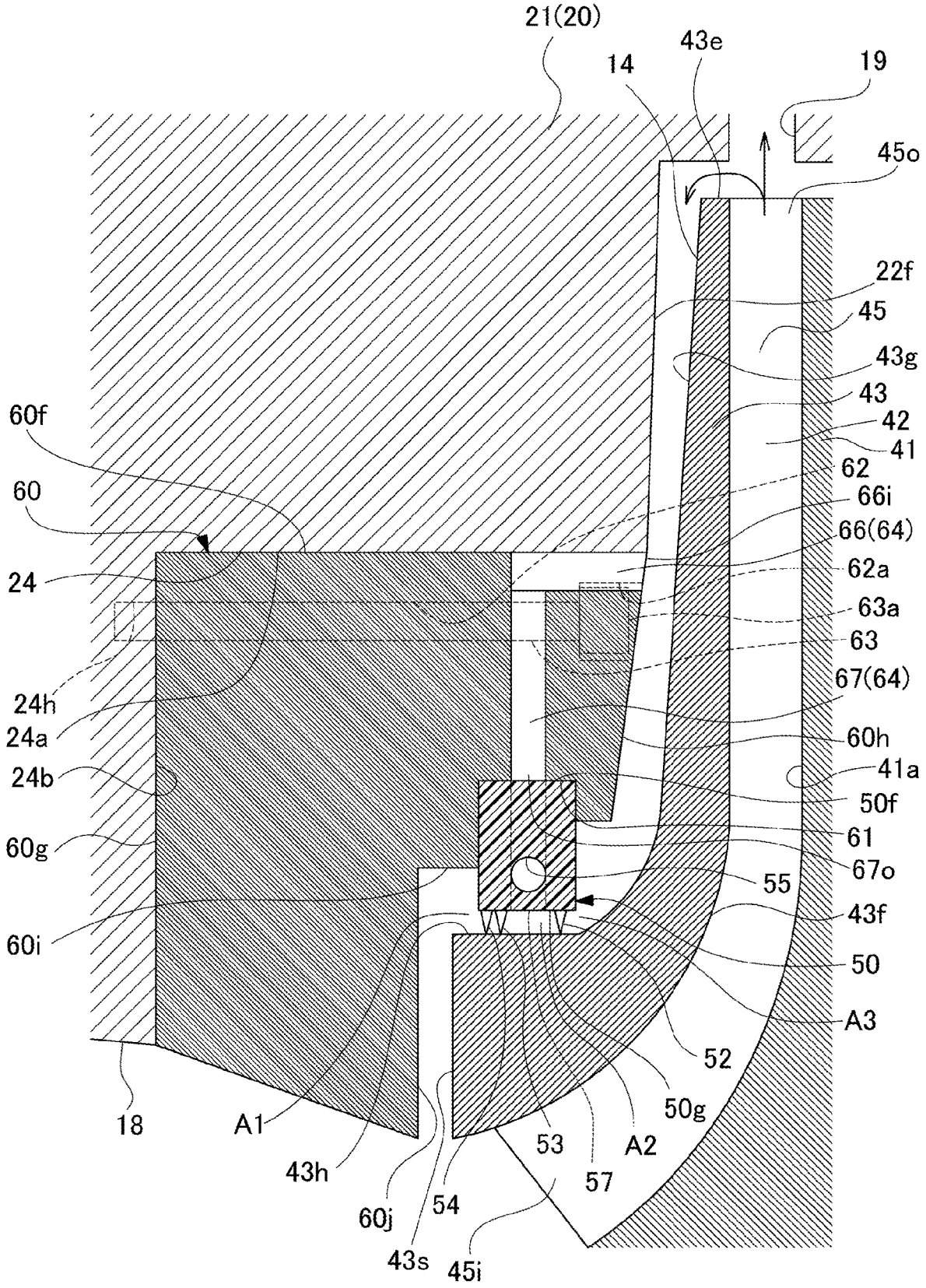
FIG. 3 is a cross-sectional view showing the configuration of a main portion of the centrifugal compressor.

The impellers 14 are respectively provided in a first end portion 13*a* and a second end portion 13*b* of the rotary shaft 13 in the axis O direction. As shown in FIGS. 2 and 3, in the present embodiment, each impeller 14 is a so-called closed impeller provided with a disk 41, a blade 42, and a cover 43.

The disk 41 has a disk shape and is fixed to the rotary shaft 13. The disk 41 is formed as a concave curved surface and the outer diameter of the disk 41 gradually increases along the axis O direction from a first surface 41*a* side on a first side of the disk 41 in the axis O direction toward a second surface 41*b* side on a second side in the axis O direction.

As shown in FIG. 2, in the present embodiment, the geared centrifugal compressor 1 is provided with the impellers 14 at both ends of the rotary shaft 13 in the axis O direction. A working fluid flows from the first side in the axis O direction (first surface 41*a* side) toward the second side in the axis O direction (second surface 41*b* side) with respect to the disk 41 of each impeller 14. In the following description, the first side in the axis O direction will be referred to as the upstream side in the axis O direction and the second side in the axis O direction will be referred to as the downstream side in the axis O direction. In other words, as for a first-stage impeller 14A provided at a first end of the rotary shaft 13 and a second-stage impeller 14B provided at a second end of the rotary shaft 13, the upstream sides in the axis O direction and the downstream sides in the axis O direction are opposite in direction to each other.

As shown in FIGS. 2 and 3, the blade 42 is provided on the first surface 41*a*, which faces the upstream side in the axis O direction in the disk 41. A plurality of the blades 42 are provided at intervals in the circumferential direction around the axis O.

The cover 43 is provided on the upstream side in the axis O direction with respect to the disk 41 and the plurality of blades 42. The cover 43 has a disk shape and is provided so as to cover the plurality of blades 42. The side of the cover 43 that faces the disk 41 in the axis O direction is formed as a convex surface 43*f* facing the disk 41 at a certain interval. The cover 43 has a cover outer peripheral surface 43*g* on the upstream side in the axis O direction. The cover outer peripheral surface 43*g* extends radially outward and toward the downstream end in the axis O direction from the upstream side in the axis O direction. The cover outer peripheral surface 43*g* has a tubular outer peripheral surface 43*h*, which extends in the axis O direction, in the end portion of the cover 43 that is on the upstream side in the axis O direction.

In each impeller 14, an impeller flow path 45 is formed between the disk 41 and the cover 43. The impeller flow path 45 has an inflow port 45*i* opening along the axis O direction on the radially inner side of the disk 41 on the first surface 41*a* side and an outflow port 45*o* opening toward the radially outer side of the impeller 14.

As shown in FIG. 2, the housing main body 21 is provided so as to cover the rotary shaft 13 and the impeller 14. In the housing main body 21, an intake flow path 18 and an exhaust flow path 19 are formed around each impeller 14. The intake flow path 18 allows the outside of the housing main body 21 and the inflow port 45*i* of the impeller flow path 45 open to the radially inner side of the impeller 14 to communicate with each other. The exhaust flow path 19 is formed on the radially outer side of the outflow port 45*o* of the impeller flow path 45. The exhaust flow path 19 has a spiral shape continuous around the axis O.

As shown in FIG. 3, the housing main body 21 has a facing surface 22*f* formed on the upstream side in the axis O direction with respect to the cover outer peripheral surface 43*g*. The facing surface 22*f* faces the cover outer peripheral surface 43*g* at an interval in the axis O direction.

A seal attachment portion 24 to which the seal holder 60 is attached is formed on the facing surface 22*f* of the housing main body 21. The seal attachment portion 24 is a groove recessed from the facing surface 22*f*. The seal attachment portion 24 has a tubular curved surface 24*a* and an attachment end surface 24*b*. The tubular curved surface 24*a* extends from the inner peripheral edge of the facing surface 22*f* to the upstream side in the axis O direction. The tubular curved surface 24*a* is curved radially inward so as to form a cylindrical shape. The attachment end surface 24*b* extends orthogonally to the radially inner side from the end portion of the tubular curved surface 24*a* that is on the upstream side in the axis O direction. In the attachment end surface 24*b*, a plurality of female screw holes 24*h* are formed at intervals in the circumferential direction around the axis O.

The seal holder 60 is provided so as to be detachable with respect to the seal attachment portion 24 of the housing main body 21. The seal holder 60 holds a seal member 50 (described later). The seal holder 60 has an annular shape as a whole. The seal holder 60 has a holder outer peripheral surface 60*f*, a tip surface 60*g*, a holder facing surface 60*h*, a seal holding surface 60*i*, and a front end facing surface 60*j*.

The holder outer peripheral surface 60*f* is a curved surface extending in the axis O direction and facing the radially outer side. The holder outer peripheral surface 60*f* has a cylindrical shape. The holder outer peripheral surface 60*f* radially faces the tubular curved surface 24*a*. The tip surface 60*g* extends orthogonally to the radially inner side from the end portion of the holder outer peripheral surface 60*f* that is on the upstream side in the axis O direction. The tip surface 60*g* is formed so as to face and abut against the attachment end surface 24*b* in the axis O direction.

The holder facing surface 60*h* is a surface facing the downstream side in the axis O direction. The holder facing surface 60*h* is formed so as to be continuous on the radially inner side with respect to the facing surface 22*f* in a state where the seal holder 60 is attached to the housing main body 21. The holder facing surface 60*h* faces the cover outer peripheral surface 43*g* at an interval in the axis O direction radially inward of the facing surface 22*f*.

The seal holding surface 60*i* is a surface facing the radially inner side radially inward of the holder facing surface 60*h*. The seal holding surface 60*i* is formed so as to face the tubular outer peripheral surface 43*h* on the upstream side in the axis O direction at an interval in the radial direction. A seal mounting groove 61 into which the seal member 50 is fitted is formed in the seal holding surface 60*i*. The seal mounting groove 61 is recessed radially outward from the seal holding surface 60*i* and is continuously formed in the circumferential direction around the axis O.

The front end facing surface 60*j* is a surface facing the downstream side in the axis O direction radially inward of the holder facing surface 60*h*. The front end facing surface 60*j* extends orthogonally to the radially inner side from the end portion of the seal holding surface 60*i* that is on the upstream side in the axis O direction. The front end facing surface 60*j* is formed so as to face a cover front end surface 43*s*, which is formed in the end portion of the cover 43 that is on the upstream side in the axis O direction, at an interval in the axis O direction.

In the seal holder 60, a bolt insertion hole 62 is formed at a plurality of circumferentially spaced locations. Each bolt insertion hole 62 extends in the axis O direction so as to penetrate the seal holder 60 from the holder facing surface 60*h* to the tip surface 60*g*. The bolt insertion hole 62 is formed so as to be at the same position as the female screw hole 24*h* when viewed from the axis O direction in a state where the seal holder 60 is attached to the housing main body 21. In a state where the seal holder 60 is accommodated in the seal attachment portion 24, a bolt 63 is inserted through each bolt insertion hole 62 from the holder facing surface 60*h* side and fastened to the female screw hole 24*h* formed in the attachment end surface 24*b*. As a result, the seal holder 60 is fixed to the housing main body 2L An accommodating recessed portion 62*a* accommodating a head portion 63*a* of the bolt 63 is formed in each bolt insertion hole 62.

Figure 4:
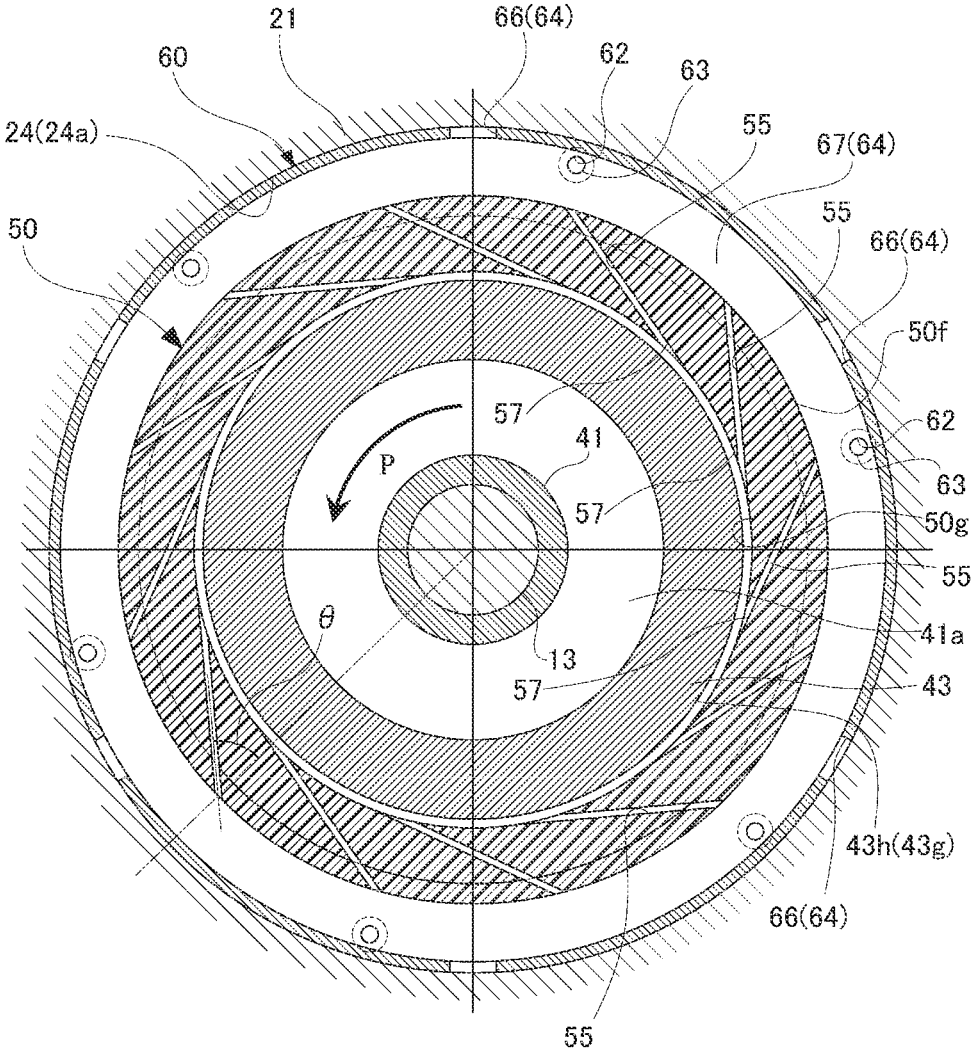
FIG. 4 is a cross-sectional view taken along arrow A-A in FIG. 2.

Further, the seal holder 60 is provided with a communication flow path portion 64. As shown in FIGS. 3 and 4, the communication flow path portion 64 is formed so as to communicate with an inclined hole 55 (described later) of the seal member 50. The communication flow path portion 64 has an introduction flow path 66 and a circumferential flow path 67.

The introduction flow path 66 is formed at a plurality of locations spaced in the circumferential direction around the axis O. In the present embodiment, the introduction flow path 66 is provided at, for example, six locations at regular intervals in the circumferential direction. Each introduction flow path 66 is formed so as to be positionally shifted in the circumferential direction so as not to interfere with the bolt insertion hole 62. Each introduction flow path 66 extends to the upstream side in the axis O direction from the holder facing surface 60*h*. Each introduction flow path 66 is formed in a groove shape recessed radially inward from the holder outer peripheral surface 60*f*. As shown in FIG. 3, the introduction flow path 66 has an introduction port 66*i* opening on the holder facing surface 60*h*. The introduction port 66*i* is open radially inward of the facing surface 22*f*. In other words, the introduction port 66*i* is open at a position facing the cover outer peripheral surface 43*g* radially inward of an outer peripheral end 43*e* of the cover 43. The outer peripheral end 43*e* is the radially outermost region in the cover 43. The outer peripheral end 43*e* has a surface facing the radially outer side.

As shown in FIGS. 3 and 4, the circumferential flow path 67 is continuously formed in the circumferential direction around the axis O. The circumferential flow path 67 is formed so as to be continuous on the radially inner side with respect to the end portion of the introduction flow path 66 that is on the upstream side in the axis O direction. The circumferential flow path 67 communicates with each introduction flow path 66 in the end portion that is on the radially outer side. The circumferential flow path 67 has an outlet 67*o*, which opens in the middle portion of the seal mounting groove 61 in the axis O direction, on the radially inner side. The outlet 67*o* is formed in the bottom surface of the seal mounting groove 61. The outlet 67*o* is continuously open over the entire circumference in the circumferential direction.

The seal member 50 has an annular shape as a whole. The outer peripheral portion of the seal member 50 is fitted in the seal mounting groove 61 of the seal holder 60. As a result, the seal member 50 is provided radially inward of the facing surface 22*f* and upstream of the facing surface 22*f* in the axis O direction.

An outer peripheral surface 50*f* of the seal member 50 is in close contact with the bottom surface of the seal mounting groove 61. An inner peripheral surface 50*g* of the seal member 50 is provided so as to face the tubular outer peripheral surface 43*h* of the cover outer peripheral surface 43*g* with a clearance having a predetermined radial dimension.

As shown in FIG. 3, the seal member 50 is integrally provided with a first fin (fin) 52 and second fins 53 and 54. The first fin 52 and the second fins 53 and 54 are respectively provided so as to be continuous in the circumferential direction. The first fin 52 and the second fins 53 and 54 protrude radially inward from the inner peripheral surface 50*g* of the seal member 50. The tips of the first fin 52 and the second fins 53 and 54 form a minute gap with respect to the tubular outer peripheral surface 43*h*.

As shown in FIGS. 3 and 4, in the seal member 50, the inclined hole 55 is formed at a plurality of locations spaced in the circumferential direction around the axis O. Each inclined hole 55 is formed such that the outer peripheral surface 50*f* and the inner peripheral surface 50*g* of the seal member 50 communicate with each other. The inclined hole 55 communicates with the circumferential flow path 67 on the outer peripheral surface 50*f*. The inclined hole 55 has an opening portion 57 opening on the inner peripheral surface 50*g*. The opening portion 57 is open at a position facing the tubular outer peripheral surface 43*h*.

The inclined hole 55 extends at an angle in the circumferential direction so as to be directed to the side opposite to the direction P of rotation of the rotary shaft 13 radially inward from the outer peripheral surface 50*f* side. Preferably, the inclined hole 55 is formed such that an inclination angle $\Theta$ with respect to the radial direction about the axis O is, for example, approximately 40° to 50° when the inclined hole 55 is viewed from the axis O direction. The plurality of inclined holes 55 may have the same inclination angle $\Theta$ in the circumferential direction or the inclination angles $\Theta$ of the plurality of inclined holes 55 may vary with the circumferential positions of the plurality of inclined holes 55.

As shown in FIG. 3, each inclined hole 55 is formed in the middle portion of the seal member 50 in the axis O direction. The opening portion 57 of the inclined hole 55 is disposed between the first fin 52 and the second fins 53 and 54. In other words, the opening portion 57 is provided side by side on the upstream side in the axis O direction with respect to the first fin 52. The opening portion 57 is provided side by side on the downstream side in the axis O direction with respect to the second fins 53 and 54.

The working fluid is taken into the impeller flow path 45 from the intake flow path 18 through the inflow port 45*i* by the impeller 14 rotating integrally with the rotary shaft 13. The working fluid is caused to flow from the inflow port 45*i* of the impeller flow path 45 toward the outflow port 45*o* by the centrifugal force that is generated by the impeller 14 rotating integrally with the rotary shaft 13. The working fluid is compressed while flowing from the inflow port 45*i* toward the outflow port 45*o*. The compressed working fluid flows radially outward from the outflow port 45*o* and is sent into the exhaust flow path 19. The working fluid is further compressed while swirling around the axis O along the exhaust flow path 19.

The impeller 14, the intake flow path 18, and the exhaust flow path 19 constitute a centrifugal compression unit 30. As a result and as shown in FIG. 1, the geared centrifugal compressor 1 is provided with a pair of the centrifugal compression units 30 disposed on both sides across the speed-increasing transmission unit 11. The pair of centrifugal compression units 30 are provided with a first-stage centrifugal compression unit 30A disposed on the first side across the speed-increasing transmission unit 11 and a second-stage centrifugal compression unit 30B disposed on the second side across the speed-increasing transmission unit 11. In other words, the geared centrifugal compressor 1 is configured as a single-shaft two-stage compressor.

In the geared centrifugal compressor 1, a fluid compressed by the first-stage impeller 14A of the first-stage centrifugal compression unit 30A subsequently flows into the second-stage centrifugal compression unit 30B. In the process of flowing through the second-stage impeller 14B of the second-stage centrifugal compression unit 30B, the fluid is further compressed and becomes a high-pressure fluid.

Part of the working fluid that has increased in pressure by passing through the impeller flow path 45 and has flowed radially outward from the outflow port 45*o* flows into the gap between the cover outer peripheral surface 43*g* and the facing surface 22*f* at the outer peripheral end 43*e* of the cover 43 and reaches a downstream side space A3, which is on the downstream side in the axis O direction with respect to the first fin 52.

Between the inner peripheral surface 50*g* and the tubular outer peripheral surface 43*h*, the pressure of an upstream side space A1, which is upstream of the second fins 53 and 54 in the axis O direction, is a pressure before the working fluid flows into the impeller flow path 45 and is compressed. In other words, the upstream side space A1 upstream of the second fins 53 and 54 in the axis O direction is lower in pressure than the downstream side space A3 on the downstream side in the axis O direction with respect to the first fin 52. Then, an opening space A2, which is a space partitioned by the first fin 52 and the second fins 53 and 54, becomes higher in pressure than the upstream side space A1 and lower in pressure than the downstream side space A3. The opening space A2 corresponds to the position where the opening portion 57 of the inclined hole 55 is formed. The opening space A2 is on the upstream side in the axis O direction with respect to the first fin 52 and is on the downstream side in the axis O direction with respect to the second fins 53 and 54.

The introduction port 66*i* is formed so as to face the downstream side space A3. The opening portion 57 is formed so as to face the opening space A2. As a result, the pressure of the introduction port 66*i* becomes higher than the pressure of the opening portion 57. The differential pressure between the introduction port 66*i* and the opening portion 57 resulting from the difference in pressure causes the working fluid that has flowed into the gap between the cover outer peripheral surface 43*g* and the facing surface 22*f* to flow into the circumferential flow path 67 via a plurality of the introduction flow paths 66. The working fluid that has flowed into the circumferential flow path 67 flows into the plurality of inclined holes 55. The working fluid that has passed through the plurality of inclined holes 55 from the communication flow path portion 64 in this manner is ejected from the opening portion 57 to the opening space A2. The working fluid ejected from the opening portion 57 through the plurality of inclined holes 55 generates a flow in the direction opposite to the direction of rotation of the rotary shaft 13. Canceled as a result is the swirling flow that flows in the direction of rotation of the rotary shaft 13 with the rotation of the impeller 14 between the tip of the first fin 52 and the tubular outer peripheral surface 43*h* or between the tips of the second fins 53 and 54 and the tubular outer peripheral surface 43*h*. As a result, swirling flow generation is suppressed and excitation of the rotary shaft 13 is suppressed.

Further, the introduction port 66*i* is open at a position facing the cover outer peripheral surface 43*g* radially inward of the outer peripheral end 43*e* of the cover 43. Accordingly, the introduction port 66*i* does not have to be provided on the radially outer side of the impeller 14 whereas the exhaust flow path 19 needs to be provided on the radially outer side of the impeller 14. Accordingly, no large space is required for the communication flow path portion 64 to be formed and the geared centrifugal compressor 1 can be reduced in size.

Since the communication flow path portion 64 is formed in the seal holder 60, machining for forming the communication flow path portion 64 does not have to be performed on the housing main body 21. By attaching the seal member 50 and the seal holder 60 to the housing main body 21, it is possible to realize the geared centrifugal compressor 1 that is capable of reducing the necessary space while reducing the swirling flow that is generated as the impeller 14 rotates.

The communication flow path portion 64 has the introduction flow path 66 and the circumferential flow path 67. With such a configuration, part of the working fluid sent radially outward through the impeller 14 can be merged into the circumferential flow path 67 from the introduction flow path 66 and sent into the plurality of inclined holes 55. Accordingly, the working fluid can be supplied to the plurality of inclined holes 55 under the same conditions regardless of the position in the circumferential direction.

The second fins 53 and 54 are provided on the upstream side in the axis O direction with respect to the first fin 52 and the opening portion 57. Suppressed as a result is direct merging between the working fluid that is ejected from the opening portion 57 of the inclined hole 55 and the pre-compression fluid that has flowed from the upstream side in the axis O direction with respect to the impeller 14. As a result, it is possible to reliably exhibit the effect of suppressing the swirling flow that is attributable to the working fluid ejected from the opening portion 57.

A seal unit 70 is provided with the seal member 50 having the inclined hole 55 and the seal holder 60 having the communication flow path portion 64. By attaching the seal unit 70 to the housing main body 21 of the geared centrifugal compressor 1, it is possible to realize the geared centrifugal compressor 1 that is capable of reducing the necessary space while reducing the swirling flow that is generated as the impeller 14 rotates. Accordingly, it is possible to enhance the effect of swirling flow reduction by adding the seal unit 70 to the existing geared centrifugal compressor 1.

Modification Example of Embodiment

Figure 5:
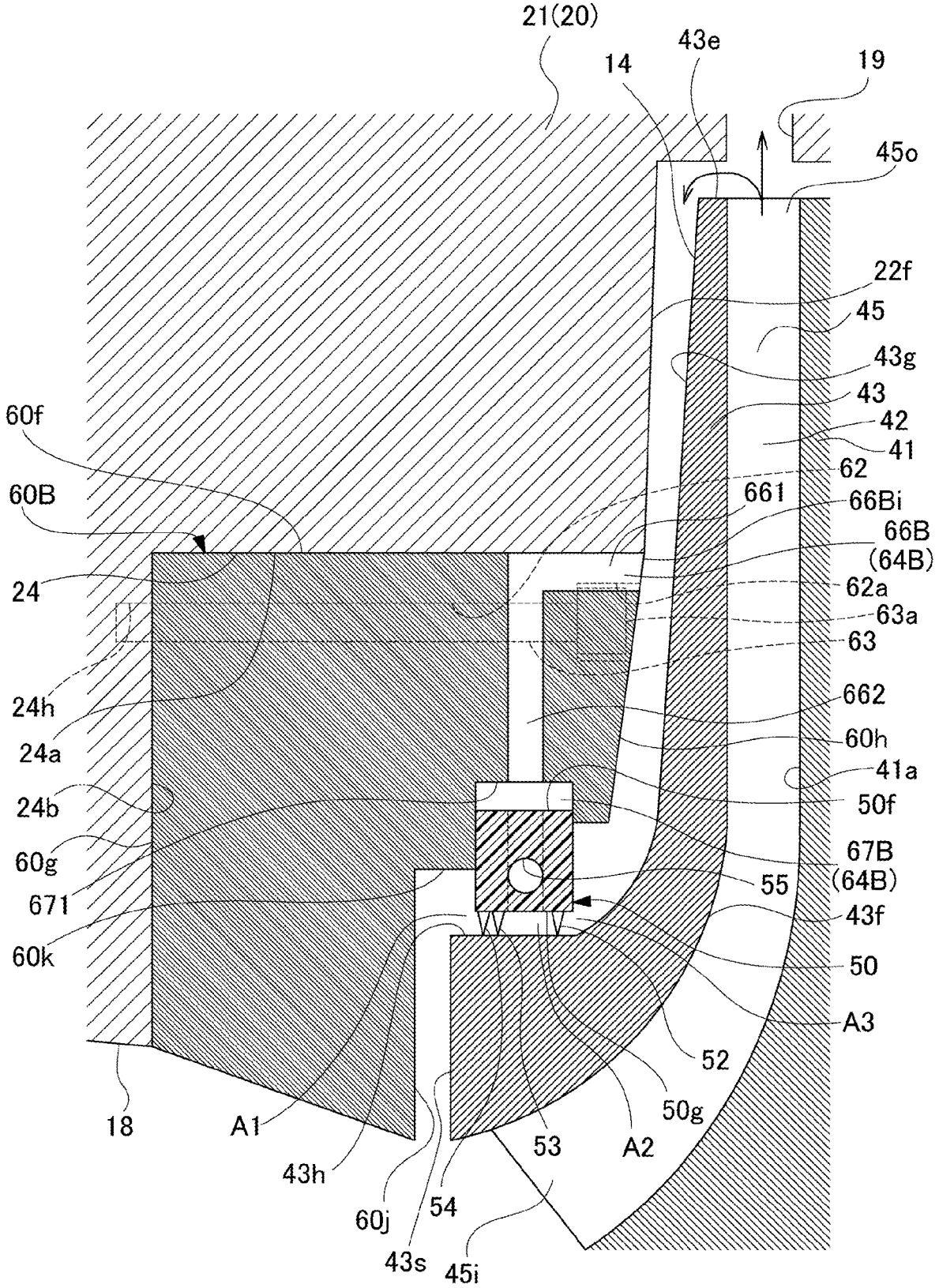
FIG. 5 is a cross-sectional view showing the configuration of a main portion of a centrifugal compressor according to a modification example of the embodiment of the present invention.

The communication flow path portion 64 is not limited to the structure as in the above embodiment. For example, a seal holder 60B is provided with a communication flow path portion 64B as shown in FIG. 5. The communication flow path portion 64B is formed so as to communicate with the inclined hole 55 (described later) of the seal member 50. The communication flow path portion 64B is provided with an introduction flow path 66B and a circumferential flow path 67B.

The introduction flow path 66B is formed at a plurality of locations spaced in the circumferential direction around the axis O. The introduction flow path 66B has an axial flow path portion 661 and a radial flow path portion 662. The axial flow path portion 661 extends to the upstream side in the axis O direction from an introduction port 66Bi formed in the holder facing surface 60*h*. The radial flow path portion 662 continuously extends radially inward from the end portion of the axial flow path portion 661 that is on the upstream side in the axis O direction. Preferably, the axial flow path portion 661 and the radial flow path portion 662 have the same flow path cross-sectional area in order to suppress a pressure loss in the introduction flow path 66B.

The circumferential flow path 67B is formed so as to be continuous in the circumferential direction in an inner peripheral surface 60*k* of the seal holder 60B. The circumferential flow path 67B is formed in a groove shape recessed radially outward from the inner peripheral surface 60*k*. The radial flow path portions 662 of a plurality of the introduction flow paths 66B communicate with the circumferential flow path 67B.

The outer peripheral portion of the seal member 50 is fitted in the circumferential flow path 67B of the seal holder 60B. The outer peripheral surface 50*f* of the seal member 50 is provided with a gap provided between the outer peripheral surface 50*f* of the seal member 50 and a bottom surface 671 of the circumferential flow path 67B. As a result, the circumferential flow path 67B continuous in the circumferential direction is formed between the outer peripheral surface 50*f* of the seal member 50 and the bottom surface 671.

In the seal holder 60B, the working fluid that has flowed into the axial flow path portion 661 from the introduction port 66Bi of each communication flow path portion 64B merges in the circumferential flow path 67B through the radial flow path portion 662. The working fluid that has flowed into the circumferential flow path 67B is ejected in the direction opposite to the direction of rotation of the rotary shaft 13 through the plurality of inclined holes 55 formed in the seal member 50. Suppressed as a result is swirling flow generation attributable to the working fluid between the seal member 50 and the cover outer peripheral surface 43*g* of the cover 43 swirling with the rotation of the impeller 14.

While preferred embodiments of the invention have been described and shown above, it should be understood that these are exemplary of the invention and are not to be considered as limiting. Additions, omissions, substitutions, and other modifications can be made without departing from the gist or scope of the present invention. Accordingly, the invention is not to be considered as being limited by the foregoing description, and is only limited by the scope of the appended claims.

For example, in the above-described embodiment, a so-called single-shaft two-stage configuration has been described as an example and as an aspect of the geared centrifugal compressor 1. However, the aspect of the geared centrifugal compressor 1 is not limited thereto and the geared centrifugal compressor 1 may be provided with two or more shafts and four or more stages depending on design and specifications. Regardless of the configuration, the same action and effect as described in the above embodiment can be obtained with the centrifugal compression unit 30 in each stage.

The present invention can be applied not only to the geared centrifugal compressor 1 but also to, for example, a single-shaft multi-stage centrifugal compressor in which the rotary shaft 13 is directly driven to rotate by an external drive source. In that case, it is preferable that the seal member 50 having the inclined hole 55 or the seal holder 60, 60B having the communication flow path portion 64, 64B is provided in the final-stage impeller where the excitation force attributable to the swirling flow is largest on the most downstream side in the flow direction of the working fluid.

EXPLANATION OF REFERENCES

1 Geared centrifugal compressor (centrifugal compressor)
11 Speed-increasing transmission unit
12 Radial bearing
13 Rotary shaft
13*a* First end portion
13*b* Second end portion
14 Impeller
14A First-stage impeller
14B Second-stage impeller
15 Pinion gear
16 Large-diameter gear
17 Thrust bearing
18 Intake flow path
19 Exhaust flow path
20 Housing
21 Housing main body
21*h* Shaft insertion hole
22*f* Facing surface
23 Seal ring
24 Seal attachment portion
24*a* Tubular curved surface
24*b* Attachment end surface
24*h* Female screw hole
30, 30A, 30B Centrifugal compression unit
41 Disk
41*a* First surface
41*b* Second surface
42 Blade
43 Cover
43*e* Outer peripheral end
43*f* Convex surface
43 *g* Cover outer peripheral surface
43*h* Tubular outer peripheral surface
43*s* Cover front end surface
45 Impeller flow path
45*i* Inflow port
45*o* Outflow port
50 Seal member
50*f* Outer peripheral surface
50*g* Inner peripheral surface
52 First fin (fin)
53, 54 Second fin
55 Inclined hole
57 Opening portion
60, 60B Seal holder
60*f* Holder outer peripheral surface
60*g* Tip surface
60*h* Holder facing surface
60*i* Seal holding surface
60*j* Front end facing surface
60*k* Inner peripheral surface
61 Seal mounting groove
62 Bolt insertion hole
62*a* Accommodating recessed portion
63 Bolt
63*a* Head portion
64, 64B Communication flow path portion
66, 66B Introduction flow path
66*i*, 66Bi Introduction port
67, 67B Circumferential flow path
67*o* Outlet
70 Seal unit
661 Axial flow path portion
662 Radial flow path portion
671 Bottom surface
A1 Upstream side space
A2 Opening space
A3 Downstream side space
O Axis
⊖ Inclination angle

What is claimed is:

1. A centrifugal compressor comprising:

a rotary shaft configured to rotate about an axis;

an impeller comprising:

a disk on one side of the impeller in an axial direction of the impeller, wherein the disk is fixed to the rotary shaft;

a cover on a second side of the impeller in the axial direction; and blades between the disk and the cover in the axial direction and provided at intervals in a circumferential direction about the axis; and a housing covering the rotary shaft and the impeller, wherein the cover comprises an outer peripheral surface that is inclined such that the outer peripheral surface gets closer to the disk in the axial direction as the outer peripheral surface extends radially outward, and the housing comprises a facing surface that is disposed farther away from the disk in the axial direction than from the cover, wherein the facing surface faces the outer peripheral surface; the centrifugal compressor further comprising:

a seal member forming a clearance with the outer peripheral surface inward of the facing surface in a radial direction in the housing;

inclined holes formed at intervals in the circumferential direction with respect to the seal member, each hole inclined in a direction opposite to a direction of rotation of the rotary shaft toward an inner side in the radial direction, and having an opening portion opening at a position facing the outer peripheral surface;

a first fin disposed on the seal member closer to the disk in the axial direction than the opening portion, wherein the first fin protrudes from the seal member toward the outer peripheral surface; and a communication flow path portion formed in a seal holder, wherein an introduction port opening faces the outer peripheral surface of the cover, and wherein the introduction port opening communicates with the inclined holes, wherein the housing has a housing main body, and the seal holder is detachable from the housing main body and the seal holder holds the seal member.

2. The centrifugal compressor according to claim 1, wherein the communication flow path portion has a circumferential flow path that is continuous in the circumferential direction and communicates with the inclined holes, and introduction flow paths connect the introduction port opening and the circumferential flow path.

3. The centrifugal compressor according to claim 2, further comprising a second fin disposed on the seal member farther away from the disk in the axial direction than the opening portion wherein the second fin protrudes from the seal member toward the outer peripheral surface.

4. The centrifugal compressor according to claim 1, further comprising a second fin disposed on the seal member farther away from the disk in the axial direction than the opening portion wherein the second fin protrudes from the seal member toward the outer peripheral surface.

5. A centrifugal compressor comprising:

a rotary shaft configured to rotate about an axis;

an impeller comprising:

a disk on one side of the impeller in an axial direction of the impeller, wherein the disk is fixed to the rotary shaft;

a cover on a second side of the impeller in the axial direction; and blades between the disk and the cover in the axial direction and provided at intervals in a circumferential direction about the axis; and a housing covering the rotary shaft and the impeller, wherein the cover comprises an outer peripheral surface that is inclined such that the outer peripheral surface gets closer to the disk in the axial direction as the outer peripheral surface extends radially outward, and the housing comprises a facing surface that is disposed farther away from the disk in the axial direction than from the cover, wherein the facing surface faces the outer peripheral surface; the centrifugal compressor further comprising:

a seal member forming a clearance with the outer peripheral surface inward of the facing surface in a radial direction in the housing;

inclined holes formed at intervals in the circumferential direction with respect to the seal member, each hole inclined in a direction opposite to a direction of rotation of the rotary shaft toward an inner side in the radial direction, and having an opening portion opening at a position facing the outer peripheral surface;

a first fin disposed on the seal member closer to the disk in the axial direction than the opening portion wherein the first fin protrudes from the seal member toward the outer peripheral surface; and a communication flow path portion formed in the housing, wherein an introduction port opening faces the outer peripheral surface of the cover, and wherein the introduction port opening communicates with the inclined holes, wherein the communication flow path portion has a circumferential flow path that is continuous in the circumferential direction and communicates with the inclined holes, and introduction flow paths connect the introduction port opening and the circumferential flow path.

6. The centrifugal compressor according to claim 5, further comprising a second fin disposed on the seal member farther away from the disk in the axial direction than the opening portion wherein the second fin protrudes from the seal member toward the outer peripheral surface.

* * * * *